US010287533B2

(12) United States Patent
Letzelter et al.

(10) Patent No.: US 10,287,533 B2
(45) **Date of Patent: *May 14, 2019**

(54) AUTOMATIC DISHWASHING CLEANING COMPOSITION

(71) Applicant: The Procter & Gamble Company, Cincinnati, OH (US)

(72) Inventors: Nathalie Sophie Letzelter, Trimdon (GB); Glenn Steven Ward, Newcastle upon Tyne (GB); Stefano Scialla, Strombeek-bever (BE); James Elliot Goodwin, Newcastle upon Tyne (GB); Frank Hulskotter, Schwalbach am Taunus (DE); Martin Ruebenacker, Altrip (DE); Aaron Flores-Figueroa, Mannheim (DE)

(73) Assignee: The Procter & Gamble Company, Cincinnati, OH (US)

( * ) Notice: Subject to any disclaimer, the term of this patent is extended or adjusted under 35 U.S.C. 154(b) by 42 days.

This patent is subject to a terminal disclaimer.

(21) Appl. No.: 15/481,493

(22) Filed: Apr. 7, 2017

(65) Prior Publication Data

US 2017/0355929 A1 Dec. 14, 2017

(30) Foreign Application Priority Data

Apr. 8, 2016 (EP) ..... 16164577

(51) Int. Cl.

| | |
|---|---|
| ***C11D 1/00*** | (2006.01) |
| ***C11D 3/37*** | (2006.01) |
| ***C11D 3/39*** | (2006.01) |
| ***C11D 3/395*** | (2006.01) |
| ***C11D 11/00*** | (2006.01) |
| *C11D 3/33* | (2006.01) |

(52) U.S. Cl.

CPC ..... *C11D 3/3707* (2013.01); *C11D 3/378* (2013.01); *C11D 3/3769* (2013.01); *C11D 3/3776* (2013.01); *C11D 3/3905* (2013.01); *C11D 3/395* (2013.01); *C11D 11/0023* (2013.01); *C11D 11/0035* (2013.01); *C11D 3/33* (2013.01); *C11D 3/3951* (2013.01)

(58) Field of Classification Search

None

See application file for complete search history.

(56) References Cited

U.S. PATENT DOCUMENTS

| | | | | |
|---|---|---|---|---|
| 5,856,164 | A | 1/1999 | Outtrup et al. | |
| 6,093,562 | A | 7/2000 | Bisgard-Frantzen et al. | |
| 6,569,261 | B1 | 5/2003 | Aubay et al. | |
| 7,645,345 | B2 | 1/2010 | Baum et al. | |
| 8,841,245 | B2 | 9/2014 | Scialla et al. | |
| 2005/0113280 | A1* | 5/2005 | Reddy | C11D 3/0036 510/475 |
| 2008/0193999 | A1 | 8/2008 | Andersen et al. | |
| 2011/0126858 | A1 | 6/2011 | Song | |

FOREIGN PATENT DOCUMENTS

| | | | |
|---|---|---|---|
| WO | WO 96/23873 | A1 | 8/1996 |
| WO | WO 99/23211 | A1 | 5/1999 |
| WO | WO 00/60060 | A2 | 10/2000 |
| WO | WO 02/074891 | A2 | 9/2002 |

OTHER PUBLICATIONS

Dr. Thomas Albers and Dr. Christine Wild: Long lasting effect polymers for hard surface cleaning, Fresh and Clean's Blog owned and operated by James Lee Senter, Jul. 8, 2014, XP002764627, Cognis GMBH, Monhein, Germany, Retrieved from the Internet: http://www.freshandclean.ca/blog/?p=225 , retrieved on Nov. 21, 2016, the whole document, 3 pages.

International Search Report; International Application No. PCT/US2017/024438; dated Jun. 21, 2017, 17 pages.

* cited by examiner

*Primary Examiner* — Necholus Ogden, Jr.

(74) *Attorney, Agent, or Firm* — John T. Dipre

(57) ABSTRACT

An automatic dishwashing cleaning composition including a dispersant polymer and a surface-modification surface-substantive polymer wherein the composition leaves glass after being washed with the composition in an automatic dishwasher with a contact angle with deionised water of less than about 50° and wherein the surface-modification surface-substantive polymer has a rivulet forming effect on water drainage from glass.

8 Claims, 2 Drawing Sheets
(2 of 2 Drawing Sheet(s) Filed in Color)

Reference glass conditioned.
Water sheets on the glass and drains.

Glass exposed to a surface- modification surface-substantive polymer.
The water drains off quickly forming rivulets.

| Active material | Composition C | Composition D | Composition E |
|---|---|---|---|
| | Comparative | Comparative | Invention |
| Cycle 2 spot count | 70 | 79 | 50 |
| Cycle 4 spot count | 96 | 96 | 51 |
| Cycle 4 pan base images |  | | |
| Comments | Spotts and streaks vissible on the surface | Golden film visible on the surface of the pan | Very few visible spots and the surface is free of films. |

AUTOMATIC DISHWASHING CLEANING COMPOSITION

FIELD OF THE INVENTION

The present invention relates to a cleaning composition, in particular an automatic dishwashing cleaning composition comprising a dispersant polymer and a surface-modification surface-substantive polymer. The composition is good for prevention of spotting and provides good shine.

BACKGROUND OF THE INVENTION

The role of a dishwashing composition is twofold: to clean soiled dishware and to leave it shiny. Typically when water dries from surfaces water-marks, smears and/or spots are left behind. These water-marks may be due to the evaporation of water from the surface leaving behind deposits of minerals which were present as dissolved solids in the water, for example calcium, magnesium and sodium ions and salts thereof or may be deposits of water-carried soils, or even remnants from the cleaning product. During the course of this work, it has been observed that this problem can be exacerbated by some cleaning compositions which modify the surface of the dishware during the automatic dishwashing process such that after rinsing, discrete droplets or beads of water remain on the surface instead of draining off. These droplets or beads dry to leave noticeable spots or marks known as water-marks. This problem is particularly apparent on ceramic, stainless steel, plastic, glass and painted surfaces.

The object of the present invention is to provide a dishwashing composition that leaves the washed dishware shiny and with reduced incidence or free of spots.

SUMMARY OF THE INVENTION

According to the first aspect of the invention, there is provided an automatic dishwashing cleaning composition. The composition comprises a combination of two polymers: a dispersant polymer and a surface-modification surface-substantive polymer.

The cleaning composition of the invention modifies the surface of the washed dishware. In the case of glass, after the glass have been washed with the composition of the invention, the contact angle with deionised water, measured after a dishwashing cycle in the presence of soil is less than about 50°, preferably from about 30°, more preferably from about 38° to about 48°, more preferably from about 40° to about 48°.

The surface-modification surface-substantive polymer modifies surfaces, such as glass such that water drains by forming rivulets that quickly recede from the glass surface without leaving marks behind. This reduces or avoids spots formation and contributes to good shine of the dishware.

The combination of the two polymers in the composition of the invention provides good cleaning and prevention of spot formation, thereby resulting in shiny dishware.

According to the second aspect of the invention, there is provided a method of dishwashing, using the composition of the invention. Dishware cleaned according to the method of the invention is left with a reduced number of spots and very shiny.

According to the last aspect of the invention, there is provided the use of the composition of the invention to reduce spotting in automatic dishwashing.

The elements of the composition of the invention described in connection with the first aspect of the invention apply mutatis mutandis to the second and third aspects of the invention.

BRIEF DESCRIPTION OF THE DRAWINGS

The present application contains at least one photograph executed in color. Copies of this patent application publication with color photographs will be provided by the Office upon request and payment of the necessary fee.

DETAILED DESCRIPTION OF THE INVENTION

Figure 1:
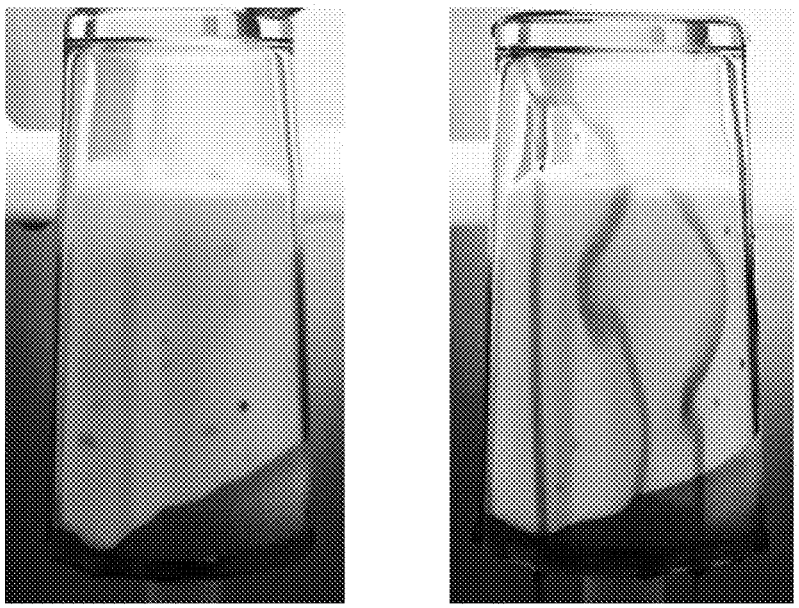
FIG. 1 is a comparison of water drainage on two glasses. One of the glasses just conditioned and the other glass exposed to a surface-modification surface-substantive polymer.

The present invention encompasses an automatic dishwashing cleaning composition, comprising a dispersant polymer and a surface-modification surface-substantive polymer. The composition greatly reduces spotting and provides excellent cleaning and shine. The invention also encompasses a method of automatic dishwashing, using the composition and the use of the composition to reduce spotting in automatic dishwashing.

For the purpose of this invention "dishware" encompasses tableware, cookware and any food-holding/handling items used for meal preparation, cooking and/or eating. Dishware is usually made of ceramic, stainless steel, plastic or glass.

Deionised Water Contact Angle Measurement Test Method

The contact angle of deionised water on glasses washed in a dishwasher with the automatic dishwashing composition of the invention in the presence of soil is measured in accordance with the following protocol.

Four new tumbler-style drinking glasses (such as Libbey® part number 158LIB Heavy Base 20 Oz. Ice Tea Glass Tumbler, from Libbey Inc, Toledo, Ohio, U.S.A.) are conditioned by washing them with a phosphate-free automatic dishwashing cleaning composition, (such as the dishwashing cleaning composition specified herein as Composition A of Example 1), and then washing the glasses again with 20 g of food-grade citric acid powder. Both washes are carried out using a Miele GSL dishwashing machine (Miele Co. Ltd, Oxon, U.K.) or equivalent, in a normal wash 50° C. program, with soft water (3 US gpg).

After being conditioned as described herein before, the glasses are washed with the composition of the invention by placing the four glasses on the top rack of the dishwasher, and placing two plastic pots containing 50 g of ATS frozen soil (as detailed herein below) into a Miele GSL dishwashing machine (Miele Co. Ltd, Oxon, U.K) or equivalent, at the start of the main wash, at the same time as the cleaning composition. A normal wash 50° C. program is carried out with hard water (20 US gpg). The glasses are removed at the end of the full wash cycle and the contact angle of deionised water is measured promptly and with great care taken to prevent contamination of the outer surface of the glass.

The contact angle measurements are conducted using a Krüss MobileDrop instrument (such as the MobileDrop model GH11, from Krüss GmbH, Hamburg, Germany), and the accompanying software (such as the Drop Shape Analysis 2 software). The measurements are run using deionised water at 20° C. Six measurements are made on the outside of each individual glass, with the six drops being distributed evenly around the circumference of the glass. Both sides of each drop's image is measured and averaged, and the total average value measured for all drops is reported.

The ATS frozen soil composition is prepared using the following ingredients and preparation instructions:

| Soil ingredient | Weight | Tolerance |
|---|---|---|
| Potato Starch—(such as Tipiak (Fecule)) | 136 g | ±0.5 g |
| Wheat Flour—(such as Rochambeau (Farine de ble)) | 109.5 g | ±0.5 g |
| Vegetable oil—(such as Asda) | 108 g | ±0.5 g |
| Margarine—(such as Stork) | 108 g | ±0.5 g |
| Lard—(such as Asda) | 108 g | ±0.5 g |
| Single Cream | 219 g | ±0.5 g |
| Baking Spread—(such as Asda Best for Baking) | 108 g | ±0.5 g |
| Contents of Large Chicken Eggs | 219 g | ±0.5 g |
| Whole Milk—(such as Asda Own) | 219 g | ±0.5 g |
| Ketchup—(such as Heinz) | 75 g | ±0.5 g |
| Mustard—Amora, (such as Moutarde de Dijon) | 100 g | ±0.5 g |
| Benzoic—(such as ex Fluka or equivalent) | 18.5 g | ±0.2 g |
| Hard Water (20 US gpg) | 918 g | ±1 g |
| Total | 2446 g | |

Soil Preparation:

1. Weigh out the appropriate amounts of each ingredient as detailed above.
2. Add water to the potato starch, heat in a pan until a gel is formed. Leave the pan to cool at room temperature overnight.
3. Add the Ketchup and mustard to a bowl and mix vigorously using food blender (such as a Blixer Coupe 5VV at Speed 6)) until fully combined, approximately 1 minute.
4. Melt Margarine (1 min), lard (2 min) and baking spread (1 min) individually in a microwave (full power 750 W) and allow to cool to room temperature (15 mins) then mix together vigorously.
5. Add Wheat Flour and Benzoic acid to a bowl and mix vigorously.
6. Break approximately 6 large eggs into a bowl and mix the egg contents vigorously (1 min).
7. Weigh out 219 g of the egg contents into a bowl. Add 219 g vegetable oil to the eggs and stir using a hand blender (1 min)
8. Mix the cream and milk in a bowl (1 min)
9. Add all of the ingredients together into a large container and mix vigorously for 10 mins using the food blender (such as Blixer Coupe 5VV at Speed 6)
10. Weigh out 50 g batches of this mixture into plastic pots and freeze at approximately −18° C.

Surface-Modification Surface-Substantive Polymer

The cleaning composition of the invention preferably comprises from about 0.01% to 10%, more preferably from 0.05% to 8%, especially from 0.1% to 5%, by weight of the cleaning composition, of the surface-modification surface-substantive polymer.

The surface-modification surface-substantive polymer of the composition of the invention provides a very characteristic water drainage profile off glass. When a glass has been treated with an aqueous composition comprising the polymer and it is then rinsed with water, the water runs off the glass forming narrow rivulets or 'water fingers' compared to the reference untreated glass where water drains off as a uniform 'film of water', as illustrated in FIG. 1.

These rivulets or 'water fingers' recede or accelerate very quickly off the glass once formed leaving no evidence of the presence of these rivulets or 'water fingers'.

Surface-Modification Surface-Substantive (SMSS) Polymer Test Method.

In order to assess whether a polymer is a surface-modification surface-substantive (SMSS) polymer within the meaning of the invention, the following test is conducted: A conditioned drinking glass (washed in an automatic dishwasher in soft water at 50° C. with a phosphate-free cleaning composition, and then washed again with 20 g of food-grade citric acid powder, as detailed herein in the contact angle measurement test method instructions section), is immersed in a solution comprising 0.5 g of test polymer in 5 L of deionised water for 20 mins. The wet glass is then placed inverted (i.e., upside down) on a support rack and rinsed with dyed water. The dyed water is comprised of 6000 mL of deionised water dyed with 8 mL of sanolin blue liquid dye EHRL (Clariant International Ltd, Muttenz, Switzerland). 100 mL of dyed water is squirted onto the outside wall of the inverted glass with a syringe having an outlet of 2 mm diameter. The flow behaviour of the dyed water is visually observed. The test polymer is considered to be a surface-modification surface-substantive polymer if the dyed water is observed to create rivulets while draining, as opposed to creating only a continuous sheet while draining (as illustrated in FIG. 1).

Without wishing to be bound by theory, it is believed that the surface-modification surface-substantive polymer works by facilitating efficient drainage of the wash liquor and/or rinsing water by forming rivulets. This helps prevent the generation of aqueous droplets which, upon drying, can result in deposition of residues on the dishware surface and consequent formation of visible spots or streaks. The surface-modification surface-substantive polymer has sufficient surface substantivity to remain on the surface of the dishware during the rinse cycles, thus providing the drainage action in the rinse phase even if the surface-modification surface-substantive polymer has been delivered into the main wash solution, together with the rest of the cleaning composition. This reduces or eliminates the need for a separate rinse aid product. The composition of the invention provides benefits on glass, ceramics, plastics and stainless steel dishware.

Preferably, the surface-modification surface-substantive polymer is cationic. By "cationic" polymer is herein meant a polymer having a net positive charge under the conditions of use. The polymer can have anionic monomers but the net charge when the polymer is used in the composition of the invention in a dishwashing operation is cationic. The cationic nature of the surface-modification surface-substantive polymer contributes to its affinity for negatively charged surfaces such as glass, ceramic and stainless steel.

A preferred polymer comprises monomers selected from the group comprising monomers of formula (I) (Monomer A) and monomers of formula (IIa-IId) (Monomer B). The polymer comprises from 60 to 99%, preferably from 70 to 95% and especially from 80 to 90% by weight of at least one monoethylenically unsaturated polyalkylene oxide monomer of the formula (I) (monomer A)

$$H_2C{=}CR^1{-}X{-}Y{-}(R^2{-}O)_nR^3 \qquad \text{I}$$

wherein Y of formula (I) is selected from —O— and —NH—; if Y of formula (I) is —O—, X of formula (I) is selected from —$CH_2$— or —CO—, if Y of formula (I) is —NH—, X of formula (I) is —CO—; $R^1$ of formula (I) is selected from hydrogen, methyl, and mixtures thereof; $R^2$ of formula (I) is independently selected from linear or branched $C_2$-$C_6$-alkylene radicals, which may be arranged blockwise or randomly; $R^3$ of formula (I) is selected from hydrogen, $C_1$-$C_4$-alkyl, and mixtures thereof; n of formula (I) is an integer from 5 to 100, preferably from 10 to 70 and more preferably from 20 to 60.

The polymer comprises from 1 to 40%, preferably from 2 to 30% and especially from 5 to 25% by weight of at least one quaternized nitrogen-containing monoethylenically unsaturated monomer of formula (IIa-IId) (monomer B).

IIa

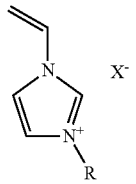

IIb

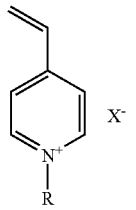

IIc

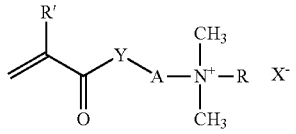

IId

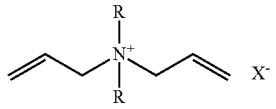

The monomers are selected such that the polymer has a weight average molecular weight ($M_w$) of from 20,000 to 500,000 g/mol, preferably from greater than 25,000 to 250,000 g/mol and especially from 30,000 to 200,000 g/mol.

The polymer preferably has a net positive charge when dissolved in an aqueous solution with a pH of 5 or above.

The polymer may further comprise monomers C and/or D. Monomer C may comprise from 0% to 15%, preferably from 0 to 10% and especially from 1 to 7% by weight of the polymer of an anionic monoethylenically unsaturated monomer.

Monomer D may comprise from 0% to 40%, preferably from 1 to 30% and especially from 5 to 20% by weight of the polymer of other non-ionic monoethylenically unsaturated monomers.

Preferred surface-modification surface-substantive polymers for use in the composition of the invention comprise, as polymerized Monomer A, monoethylenically unsaturated polyalkylene oxide monomers of formula (I) in which Y of formula (I) is —O—; X of formula (I) is —CO—; $R^1$ of formula (I) is hydrogen or methyl; $R^2$ of formula (I) is independently selected from linear or branched $C_2$-$C_4$-alkylene radicals arranged blockwise or randomly, preferably ethylene, 1,2- or 1,3-propylene or mixtures thereof, particularly preferably ethylene; $R^3$ of formula (I) is methyl; and n is an integer from 5 to 100.

Monomer A

A monomer A may be, for example:

(a) reaction products of (meth)acrylic acid with polyalkylene glycols which are not terminally capped, terminally capped at one end by alkyl radicals; and (b) alkenyl ethers of polyalkylene glycols which are not terminally capped or terminally capped at one end by alkyl radicals.

Preferred monomer A is the (meth)acrylates and the allyl ethers, where the acrylates and primarily the methacrylates are particularly preferred. Particularly suitable examples of the monomer A are:

(a) methylpolyethylene glycol (meth)acrylate and (meth) acrylamide, methylpolypropylene glycol (meth)acrylate and (meth)acrylamide, methylpolybutylene glycol (meth)acrylate and (meth)acrylamide, methylpoly(propylene oxide-co-ethylene oxide) (meth)acrylate and (meth)acrylamide, ethylpolyethylene glycol (meth) acrylate and (meth)acrylamide, ethylpolypropylene glycol (meth)acrylate and (meth)acrylamide, ethylpolybutylene glycol (meth)acrylate and (meth)acrylamide and ethylpoly(propylene oxide-co-ethylene oxide) (meth)acrylate and (meth)acrylamide, each with 5 to 100, preferably 10 to 70 and particularly preferably 20 to 60, alkylene oxide units, where methylpolyethylene glycol acrylate is preferred and methylpolyethylene glycol methacrylate is particularly preferred;

(b) ethylene glycol allyl ethers and methylethylene glycol allyl ethers, propylene glycol allyl ethers and methylpropylene glycol allyl ethers each with 5 to 100, preferably 10 to 70 and particularly preferably 20 to 60, alkylene oxide units.

The proportion of Monomer A in the polymer is 60% to 99% by weight, preferably 70% to 95%, more preferably from 75% to 90% by weight of the polymer.

Monomer B

A monomer B that is particularly suitable includes the quaternization products of 1-vinylimidazoles, of vinylpyridines, of (meth)acrylic esters with amino alcohols, in particular N,N-di-$C_1$-$C_4$-alkylamino-$C_2$-$C_6$-alcohols, of amino-containing (meth)acrylamides, in particular N,N-di-$C_1$-$C_4$-alkyl-amino-$C_2$-$C_6$-alkylamides of (meth)acrylic acid, and of diallylalkylamines, in particular diallyl-$C_1$-$C_4$-alkylamines.

Suitable monomers B have the formula IIa to IId:

IIa

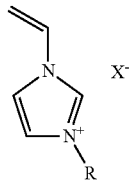

IIb

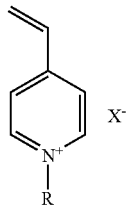

-continued

IIc

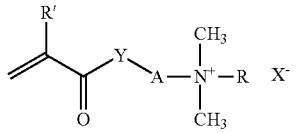

IId

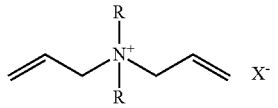

wherein R of formula IIa to IId is selected from $C_1$-$C_4$-alkyl or benzyl, preferably methyl, ethyl or benzyl; R' of formula IIc is selected from hydrogen or methyl; Y of formula IIc is selected from —O— or —NH—; A of formula IIc is selected from $C_1$-$C_6$-alkylene, preferably straight-chain or branched $C_2$-$C_4$-alkylene, in particular 1,2-ethylene, 1,3- and 1,2-propylene or 1,4-butylene; $X^-$ of formula IIa to IId is selected from halide, such as iodide and preferably chloride or bromide, $C_1$-$C_4$-alkyl sulfate, preferably methyl sulfate or ethyl sulfate, $C_1$-$C_4$-alkylsulfonate, preferably methylsulfonate or ethylsulfonate, $C_1$-$C_4$-alkyl carbonate; and mixtures thereof.

Specific examples of preferred monomer B that may be utilized are:

(a) 3-methyl-1-vinylimidazolium chloride, 3-methyl-1-vinylimidazolium methyl sulfate, 3-ethyl-1-vinylimidazolium ethyl sulfate, 3-ethyl 1-vinylimidazolium chloride and 3-benzyl-1-vinylimidazolium chloride;

(b) 1-methyl-4-vinylpyridinium chloride, 1-methyl-4-vinylpyridinium methyl sulfate and 1-benzyl-4-vinylpyridinium chloride;

(c) 3-methacrylamido-N,N,N-trimethylpropan-1-aminium chloride, 3-acryl-N,N,N-trimethylpropan-1-aminium chloride, 3-acryl-N,N,N-trimethylpropan-1-aminium methylsulfate, 3-methacryl-N,N,N-trimethylpropan-1-aminium chloride, 3-methacryl-N,N,N-trimethylpropan-1-aminium methylsulfate, 2-acrylamido-N,N,N-trimethylethan-1-aminium chloride, 2-acryl-N,N,N-trimethylethan-1-aminium chloride, 2-acryl-N,N,N-trimethylethan-1-aminium methyl sulfate, 2-methacryl-N,N,N-trimethylethan-1-aminium chloride, 2-methacryl-N,N,N-trimethylethan-1-aminium methyl sulfate, 2-acryl-N,N-dimethyl-N-ethylethan-1-aminium ethylsulfate, 2-methacryl-N,N-dimethyl-N-ethylethan-1-aminium ethylsulfate, and (d) dimethyldiallylammonium chloride and diethyldiallylammonium chloride.

A preferred monomer B is selected from 3-methyl-1-vinylimidazolium chloride, 3-methyl-1-vinylimidazolium methyl sulfate, 3-methacryl-N,N,N-trimethylpropan-1-aminium chloride, 2-methacryl-N,N,N-trimethylethan-1-aminium chloride, 2-methacryl-N,N-dimethyl-N-ethylethan-1-aminium ethylsulfate, and dimethyldiallylammonium chloride.

The polymer comprises 1% to 40% by weight, preferably 2% to 30%, and especially preferable from 5 to 20% by weight of the polymer, of Monomer B. The weight ratio of Monomer A to Monomer B is preferably equal to or greater than 2:1, preferably from 3:1 to 5:1.

Monomer C

As optional components of the polymer of the present invention, monomers C and D may also be utilized. Monomer C is selected from anionic monoethylenically unsaturated monomers. Suitable monomer C may be selected from:

(a) α,β-unsaturated monocarboxylic acids which preferably have 3 to 6 carbon atoms, such as acrylic acid, methacrylic acid, 2-methylenebutanoic acid, crotonic acid and vinylacetic acid, preference being given to acrylic acid and methacrylic acid;

(b) unsaturated dicarboxylic acids, which preferably have 4 to 6 carbon atoms, such as itaconic acid and maleic acid, anhydrides thereof, such as maleic anhydride;

(c) ethylenically unsaturated sulfonic acids, such as vinylsulfonic acid, acrylamidopropanesulfonic acid, methallylsulfonic acid, methacrylsulfonic acid, m- and p-styrenesulfonic acid, (meth)acrylamidomethanesulfonic acid, (meth)acrylamidoethanesulfonic acid, (meth)acrylamidopropanesulfonic acid, 2-(meth)acrylamido-2-methylpropanesulfonic acid, 2-acrylamido-2-butanesulfonic acid, 3-methacrylamido-2-hydroxypropanesulfonic acid, methanesulfonic acid acrylate, ethanesulfonic acid acrylate, propanesulfonic acid acrylate, allyloxybenzenesulfonic acid, methallyloxybenzenesulfonic acid and 1-allyloxy-2-hydroxypropanesulfonic acid; and (d) ethylenically unsaturated phosphonic acids, such as vinylphosphonic acid and m- and p-styrenephosphonic acid.

The anionic Monomer C can be present in the form of water soluble free acids or in water-soluble salt form, especially in the form of alkali metal and ammonium, in particular alkylammonium, salts, and preferred salts being the sodium salts.

A preferred Monomer C may be selected from acrylic acid, methacrylic acid, maleic acid, vinylsulfonic acid, 2-(meth)acrylamido-2-methylpropanesulfonic acid and vinylphosphonic acid, particular preference being given to acrylic acid, methacrylic acid and 2-acrylamido-2-methylpropanesulfonic acid.

The proportion of monomer C in the polymer can be up to 15% by weight, preferably from 1% to 5% by weight of the polymer.

If monomer C is present in the polymer, then, the molar ratio of monomer B to monomer C is greater than 1. The weight ratio of Monomer A to monomer C is preferably equal to or greater than 4:1, more preferably equal to or greater than 5:1. Additionally, the weight ratio of monomer B to monomer C is equal or greater than 2:1, and even more preferable from 2.5:1 to less than 20:1. Polymers having these ratios may impart effective levels of surface modification to reduce or decrease spotting and provide shiny surfaces.

Monomer D

As an optional component of the polymer, monomer D may also be utilized. Monomer D is selected from nonionic monoethylenically unsaturated monomers selected from:

(a) esters of monoethylenically unsaturated $C_3$-$C_6$-carboxylic acids, especially acrylic acid and methacrylic acid, with monohydric $C_1$-$C_{22}$-alcohols, in particular $C_1$-$C_{16}$-alcohols; and hydroxyalkyl esters of monoethylenically unsaturated $C_3$-$C_6$-carboyxlic acids, especially acrylic acid and methacrylic acid, with divalent $C_2$-$C_4$-alcohols, such as methyl (meth)acrylate, ethyl (meth)acrylate, n-butyl (meth)acrylate, sec-butyl (meth)acrylate, tert-butyl (meth)acrylate, ethylhexyl (meth)acrylate, decyl (meth)acrylate, lauryl (meth) acrylate, isobornyl (meth)acrylate, cetyl (meth)acrylate, palmityl (meth)acrylate and stearyl (meth)acrylate, hydroxyethyl (meth)acrylate, hydroxypropyl (meth)acrylate and hydroxybutyl (meth)acrylate;

(b) amides of monoethylenically unsaturated $C_3$-$C_6$-carboxylic acids, especially acrylic acid and methacrylic acid, with $C_1$-$C_{12}$-alkylamines and di($C_1$-$C_4$-alkyl) amines, such as N-methyl(meth)acrylamide, N,N-dimethyl(meth)acrylamide, N-ethyl(meth)acrylamide, N-propyl(meth)acrylamide, N-tert-butyl(meth)acrylamide, N-tert-octyl(meth)acrylamide and N-undecyl (meth)acrylamide, and (meth)acrylamide;

(c) vinyl esters of saturated $C_2$-$C_{30}$-carboxylic acids, in particular $C_2$-$C_{14}$-carboxylic acids, such as vinyl acetate, vinyl propionate, vinyl butyrate, vinyl 2-ethylhexanoate and vinyl laurate;

(d) vinyl $C_1$-$C_{30}$-alkyl ethers, in particular vinyl $C_1$-$C_{18}$-alkyl ethers, such as vinyl methyl ether, vinyl ethyl ether, vinyl n-propyl ether, vinyl isopropyl ether, vinyl n-butyl ether, vinyl isobutyl ether, vinyl 2-ethylhexyl ether and vinyl octadecyl ether;

(e) N-vinylamides and N-vinyllactams, such as N-vinylformamide, N-vinyl-N-methyl-formamide, N-vinylacetamide, N-vinyl-N-methylacetamide, N-vinylimidazol, N-vinylpyrrolidone, N-vinylpiperidone and N-vinylcaprolactam;

(f) aliphatic and aromatic olefins, such as ethylene, propylene, $C_4$-$C_{24}$-α-olefins, in particular $C_4$-$C_{16}$-α-olefins, e.g. butylene, isobutylene, diisobutene, styrene and α-methylstyrene, and also diolefins with an active double bond, e.g. butadiene;

(g) unsaturated nitriles, such as acrylonitrile and methacrylonitrile.

A preferred monomer D is selected from methyl (meth) acrylate, ethyl (meth)acrylate, (meth)acrylamide, vinyl acetate, vinyl propionate, vinyl methyl ether, N-vinylformamide, N-vinylpyrrolidone, N-vinylimidazole and N-vinylcaprolactam. N-vinylimidazol is particularly preferred.

If the monomer D is present in the polymer, then the proportion of monomer D may be up to 40%, preferably from 1% to 30%, more preferably from 5% to 20% by weight of the polymer.

Preferred polymers of the present invention include:

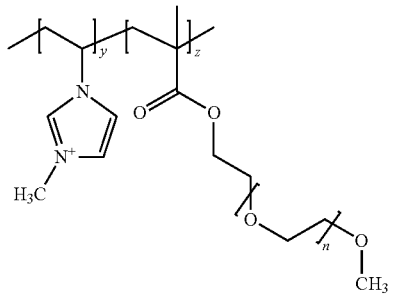

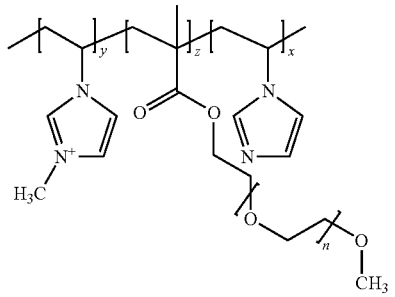

wherein indices y and z are such that the monomer ratio (z:y) is from 3:1 to 20:1 and the indices x and z are such that the monomer ratio (z:x) is from 1.5:1 to 20:1, and the polymer has a weight average molecular weight of from 20,000 to 500,000 g/mol, preferably from greater than 25,000 to 250,000 g/mol and especially from 30,000 to 200,000 g/mol.

These polymers can be prepared by free-radical polymerization of the Monomers A and B and if desired C and/or D. The free-radical polymerization of the monomers can be carried out in accordance with all known methods, preference being given to the processes of solution polymerization and of emulsion polymerization. Suitable polymerization initiators are compounds which decompose thermally or photochemically (photoinitiators) to form free radicals, such as benzophenone, acetophenone, benzoin ether, benzyl dialkyl ketones and derivatives thereof.

The polymerization initiators are used according to the requirements of the material to be polymerized, usually in amounts of from 0.01% to 15%, preferably 0.5% to 5% by weight based on the monomers to be polymerized, and can be used individually or in combination with one another.

Instead of a quaternized Monomer B, it is also possible to use the corresponding tertiary amines In this case, the quaternization is carried out after the polymerization by reacting the resulting copolymer with alkylating agents, such as alkyl halides, dialkyl sulfates and dialkyl carbonates, or benzyl halides, such as benzyl chloride. Examples of suitable alkylating agents which may be mentioned are, methyl chloride, bromide and iodide, ethyl chloride and bromide, dimethyl sulfate, diethyl sulfate, dimethyl carbonate and diethyl carbonate.

The anionic monomer C can be used in the polymerization either in the form of the free acids or in a form partially or completely neutralized with bases. Specific examples that may be listed are: sodium hydroxide solution, potassium hydroxide solution, sodium carbonate, sodium hydrogen carbonate, ethanolamine, diethanolamine and triethanolamine.

To limit the molar masses of the polymers, customary regulators can be added during the polymerization, e.g. mercapto compounds, such as mercaptoethanol, thioglycolic acid and sodium disulfite. Suitable amounts of regulator are 0.1% to 5% by weight based on the monomers to be polymerized.

Other preferred polymers may comprise combinations of Monomers B, C and D, where the molar percent of monomer B is higher than the molar content of monomer C, rendering a net positive charge to the copolymer.

Preferred surface-modification surface-substantive polymer for use herein are those comprising methylpolyethylene glycol (meth)acrylate as monomer A. Also preferred polymers for use herein are those comprising a salt of 3-methyl-1-vinylimidazolium as monomer B. Especially preferred polymers for use herein comprises methylpolyethylene glycol (meth)acrylate as monomer A and a salt of 3-methyl-1-vinylimidazolium as monomer B. More preferably the polymer comprises from 70 to 80% by weight of the polymer of methylpolyethylene glycol (meth)acrylate and from 10 to 30% by weight of the polymer of a salt of 3-methyl-1-vinylimidazolium. These polymers have been found to reduce the number of spots and filming on washed surfaces leaving the surfaces shiny.

There are also preferred surface-modification surface-substantive polymers comprising methylpolyethylene glycol (meth)acrylate as monomer A, a salt of 3-methyl-1-vinylimidazolium as monomer B and N-vinylimidazole as monomer D.

Preferred copolymers are those in which the ethylene glycol unit is repeated from 3 to 100, more preferably from 10 to 80 and especially from 15 to 50.

Some commercially available polymers from the PolyQuart series from BASF may be suitable surface modification surface-substantive polymers for the composition of the invention.

PolyQuart Ampho 149, a modified polyacrylate, is an aqueous terpolymer comprising 3-methacrylamido-N,N,N-trimethylpropan-1-aminium chloride (Monomer B), 2-ethylacrylic acid and acrylic acid (Monomer C).

PolyQuat Pro A is also a cationic polyamide, comprising N-isopropylacryl amide (Monomer D), 3-methacrylamido-N,N,N-trimethylpropan-1-aminium chloride (Monomer B), and the sulphonated monomer 2-acrylamide-2-methylpropanesulfonate (Monomer B).

SOKALAN HP series from BASF are homo- or copolymers based on vinylpyrrolidone, vinylimidazole and monomers with nonionic character, which may also be used as surface-modification, surface-substantive polymers within the meaning of the invention.

Combinations of surface-modification, surface-substantive polymers are also useful herein.

Dispersant Polymer

The dispersant polymer is used in any suitable amount from about 0.1 to about 20%, preferably from 0.2 to about 15%, more preferably from 0.3 to % by weight of the composition.

The dispersant polymer is capable to suspend calcium or calcium carbonate in an automatic dishwashing process.

The dispersant polymer has a calcium binding capacity within the range between 30 to 250 mg of Ca/g of dispersant polymer, preferably between 35 to 200 mg of Ca/g of dispersant polymer, more preferably 40 to 150 mg of Ca/g of dispersant polymer at 25° C. In order to determine if a polymer is a dispersant polymer within the meaning of the invention, the following calcium binding-capacity determination is conducted in accordance with the following instructions:

Calcium Binding Capacity Test Method

The calcium binding capacity referred to herein is determined via titration using a pH/ion meter, such as the Meettler Toledo SevenMulti™ bench top meter and a PerfectION™ comb Ca combination electrode. To measure the binding capacity a heating and stirring device suitable for beakers or tergotometer pots is set to 25° C., and the ion electrode with meter are calibrated according to the manufacturer's instructions. The standard concentrations for the electrode calibration should bracket the test concentration and should be measured at 25° C. A stock solution of 1000 mg/g of Ca is prepared by adding 3.67 g of $CaCl_2$-$2H_2O$ into 1 L of deionised water, then dilutions are carried out to prepare three working solutions of 100 mL each, respectively comprising 100 mg/g, 10 mg/g, and 1 mg/g concentrations of Calcium. The 100 mg Ca/g working solution is used as the initial concentration during the titration, which is conducted at 25° C. The ionic strength of each working solution is adjusted by adding 2.5 g/L of NaCl to each. The 100 mL of 100 mg Ca/g working solution is heated and stirred until it reaches 25° C. The initial reading of Calcium ion concentration is conducted at when the solution reaches 25° C. using the ion electrode. Then the test polymer is added incrementally to the calcium working solution (at 0.01 g/L intervals) and measured after 5 minutes of agitation following each incremental addition. The titration is stopped when the solution reaches 1 mg/g of Calcium. The titration procedure is repeated using the remaining two calcium concentration working solutions. The binding capacity of the test polymer is calculated as the linear slope of the calcium concentrations measured against the grams/L of test polymer that was added.

The dispersant polymer preferably bears a negative net charge when dissolved in an aqueous solution with a pH greater than 6.

The dispersant polymer can bear also sulfonated carboxylic esters or amides, in order to increase the negative charge at lower pH and improve their dispersing properties in hard water. The preferred dispersant polymers are sulfonated/carboxylated polymers, i.e., polymer comprising both sulfonated and carboxylated monomers.

Preferably, the dispersant polymers are sulfonated derivatives of polycarboxylic acids and may comprise two, three, four or more different monomer units. The preferred copolymers contain:

At least one structural unit derived from a carboxylic acid monomer having the general formula (III):

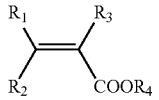

(III)

wherein $R_1$ to $R_3$ are independently selected from hydrogen, methyl, linear or branched saturated alkyl groups having from 2 to 12 carbon atoms, linear or branched mono or polyunsaturated alkenyl groups having from 2 to 12 carbon atoms, alkyl or alkenyl groups as aforementioned substituted with —NH2 or —OH, or —COOH, or $COOR_4$, where $R_4$ is selected from hydrogen, alkali metal, or a linear or branched, saturated or unsaturated alkyl or alkenyl group with 2 to 12 carbons;

Preferred carboxylic acid monomers include one or more of the following: acrylic acid, maleic acid, maleic anhydride, itaconic acid, citraconic acid, 2-phenylacrylic acid, cinnamic acid, crotonic acid, fumaric acid, methacrylic acid, 2-ethylacrylic acid, methylenemalonic acid, or sorbic acid. Acrylic and methacrylic acids being more preferred.

Optionally, one or more structural units derived from at least one nonionic monomer having the general formula (IV):

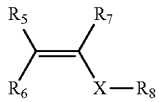

(IV)

Wherein $R_5$ to $R_7$ are independently selected from hydrogen, methyl, phenyl or hydroxyalkyl groups containing 1 to 6 carbon atoms, and can be part of a cyclic structure, X is an optionally present spacer group which is selected from —$CH_2$—, —COO—, —CONH— or —$CONR_8$—, and $R_8$ is selected from linear or branched, saturated alkyl radicals having 1 to 22 carbon atoms or unsaturated, preferably aromatic, radicals having from 6 to 22 carbon atoms.

Preferred non-ionic monomers include one or more of the following: butene, isobutene, pentene, 2-methylpent-1-ene, 3-methylpent-1-ene, 2,4,4-trimethylpent-1-ene, 2,4,4-trimethylpent-2-ene, cyclopentene, methylcyclopentene, 2-methyl-3-methyl-cyclopentene, hexene, 2,3-dimethylhex-1-ene, 2,4-dimethylhex-1-ene, 2,5-dimethylhex-1-ene, 3,5-dimethylhex-1-ene, 4,4-dimethylhex-1-ene, cyclohexene, methylcyclohexene, cycloheptene, alpha olefins having 10 or more carbon atoms such as, dec-1-ene, dodec-1-ene, hexadec-1-ene, octadec-1-ene and docos-1-ene, preferred aromatic monomers are styrene, alpha methylstyrene, 3-methylstyrene, 4-dodecylstyrene, 2-ethyl-4-bezylstyrene, 4-cyclohexylstyrene, 4-propylstyrol, 1-vinylnaphtalene, 2-vinylnaphtalene; preferred carboxylic ester monomers are methyl (meth)acrylate, ethyl (meth)acrylate, propyl (meth) acrylate, t-butyl (meth)acrylate, pentyl (meth)acrylate, hexyl (meth)acrylate, 2-ethylhexyl (meth)acrylate, octyl (meth) acrylate, lauryl (meth)acrylate, stearyl (meth)acrylate and behenyl (meth)acrylate; preferred amides are N-methyl acrylamide, N-ethyl acrylamide, N-t-butyl acrylamide, N-2-ethylhexyl acrylamide, N-octyl acrylamide, N-lauryl acrylamide, N-stearyl acrylamide, N-behenyl acrylamide.

and at least one structural unit derived from at least one sulfonic acid monomer having the general formula (V) and (VI):

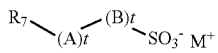

(V)

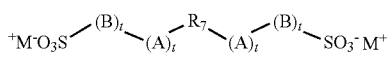

(VI)

wherein $R_7$ is a group comprising at least one sp2 bond, A is O, N, P, S, an amido or ester linkage, B is a mono- or polycyclic aromatic group or an aliphatic group, each t is independently 0 or 1, and M+ is a cation. In one aspect, $R_7$ is a C2 to C6 alkene. In another aspect, R7 is ethene, butene or propene.

Preferred sulfonated monomers include one or more of the following: 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy) propanesulfonic acid, 2-methyl-2-propen-1-sulfonic acid, styrenesulfonic acid, vinylsulfonic acid, 3-sulfopropyl, 3-sulfo-propylmethacrylate, sulfomethacrylamide, sulfomethylmethacrylamide and mixtures of said acids or their water-soluble salts.

Preferably, the polymer comprises the following levels of monomers: from about 40 to about 90%, preferably from about 60 to about 90% by weight of the polymer of one or more carboxylic acid monomer; from about 5 to about 50%, preferably from about 10 to about 40% by weight of the polymer of one or more sulfonic acid monomer; and optionally from about 1% to about 30%, preferably from about 2 to about 20% by weight of the polymer of one or more non-ionic monomer. An especially preferred polymer comprises about 70% to about 80% by weight of the polymer of at least one carboxylic acid monomer and from about 20% to about 30% by weight of the polymer of at least one sulfonic acid monomer.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

The carboxylic acid is preferably (meth)acrylic acid. The sulfonic acid monomer is preferably 2-acrylamido-2-propanesulfonic acid (AMPS).

Preferred commercial available polymers include: Alcosperse 240, Aquatreat AR 540 and Aquatreat MPS supplied by Alco Chemical; Acumer 3100, Acumer 2000, Acusol 587G and Acusol 588G supplied by Rohm & Haas; Goodrich K-798, K-775 and K-797 supplied by BF Goodrich; and ACP 1042 supplied by ISP technologies Inc. Particularly preferred polymers are Acusol 587G and Acusol 588G supplied by Rohm & Haas.

Suitable dispersant polymers include anionic carboxylic polymer of low molecular weight. They can be homopolymers or copolymers with a weight average molecular weight of less than or equal to about 200,000 g/mol, or less than or equal to about 75,000 g/mol, or less than or equal to about 50,000 g/mol, or from about 3,000 to about 50,000 g/mol, preferably from about 5,000 to about 45,000 g/mol. The dispersant polymer may be a low molecular weight homopolymer of polyacrylate, with an average molecular weight of from 1,000 to 20,000, particularly from 2,000 to 10,000, and particularly preferably from 3,000 to 5,000.

The dispersant polymer may be a copolymer of acrylic with methacrylic acid, acrylic and/or methacrylic with maleic acid, and acrylic and/or methacrylic with fumaric acid, with a molecular weight of less than 70,000. Their molecular weight ranges from 2,000 to 80,000 and more preferably from 20,000 to 50,000 and in particular 30,000 to 40,000 g/mol. and a ratio of (meth)acrylate to maleate or fumarate segments of from 30:1 to 1:2.

The dispersant polymer may be a copolymer of acrylamide and acrylate having a molecular weight of from 3,000 to 100,000, alternatively from 4,000 to 20,000, and an acrylamide content of less than 50%, alternatively less than 20%, by weight of the dispersant polymer can also be used. Alternatively, such dispersant polymer may have a molecular weight of from 4,000 to 20,000 and an acrylamide content of from 0% to 15%, by weight of the polymer.

Dispersant polymers suitable herein also include itaconic acid homopolymers and copolymers.

Alternatively, the dispersant polymer can be selected from the group consisting of alkoxylated polyalkyleneimines, alkoxylated polycarboxylates, polyethylene glycols, styrene co-polymers, cellulose sulfate esters, carboxylated polysaccharides, amphiphilic graft copolymers and mixtures thereof.

Automatic Dishwashing Cleaning Composition

The automatic dishwashing cleaning composition can be in any physical form. It can be a loose powder, a gel or presented in unit dose form. Preferably it is in unit dose form, unit dose forms include pressed tablets and water-soluble packs. The automatic dishwashing cleaning composition of the invention is preferably presented in unit-dose form and it can be in any physical form including solid, liquid and gel form. The composition of the invention is very well suited to be presented in the form of a multi-compartment pack, more in particular a multi-compartment pack comprising compartments with compositions in different physical forms, for example a compartment comprising a composition in solid form and another compartment comprising a composition in liquid form. The composition is preferably enveloped by a water-soluble film such as polyvinyl alcohol. Especially preferred are compositions in unit dose form wrapped in a polyvinyl alcohol film having a thickness of less than 100 μm. The detergent composition of the invention weighs from about 8 to about 25 grams, preferably from about 10 to about 20 grams. This weight range fits comfortably in a dishwasher dispenser. Even though this range amounts to a low amount of detergent, the detergent has been formulated in a way that provides all the benefits mentioned herein above.

The composition is preferably phosphate free. By "phosphate-free" is herein understood that the composition comprises less than 1%, preferably less than 0.1% by weight of the composition of phosphate.

Excellent cleaning and shine benefits are obtained with compositions comprising the surface-modification surface-substantive polymer and dispersant polymers of the invention and a complexing agent. For the purpose of this invention a "complexing agent" is a compound capable of binding polyvalent ions such as calcium, magnesium, lead, copper, zinc, cadmium, mercury, manganese, iron, aluminium and other cationic polyvalent ions to form a water-soluble complex. The complexing agent has a logarithmic stability constant ([log K]) for Ca2+ of at least 5, preferably at least 6. The stability constant, log K, is measured in a solution of ionic strength of 0.1, at a temperature of 25° C.

Preferably, the composition of the invention comprises an amino-carboxylated complexing agent, preferably selected from the group consisting of methyl-glycine-diacetic acid (MGDA), its salts and derivatives thereof, glutamic-N,N-diacetic acid (GLDA), its salts and derivatives thereof, iminodisuccinic acid (IDS), its salts and derivatives thereof, carboxy methyl inulin, its salts and derivatives thereof and mixtures thereof. Especially preferred complexing agent for use herein is selected from the group consisting of MGDA and salts thereof, especially preferred for use herein is the three sodium salt of MGDA. Preferably, the complexing agent is the three sodium salt of MGDA and the dispersant polymer is a sulfonated polymer, more preferably comprising 2-acrylamido-2-methylpropane sulfonic acid monomer.

Bleach

The composition of the invention preferably comprises from about 1 to about 20%, more preferably from about 5 to about 18%, even more preferably from about 8 to about 15% of bleach by weight of the composition.

Inorganic and organic bleaches are suitable for use herein. Inorganic bleaches include perhydrate salts such as perborate, percarbonate, perphosphate, persulfate and persilicate salts. The inorganic perhydrate salts are normally the alkali metal salts. The inorganic perhydrate salt may be included as the crystalline solid without additional protection. Alternatively, the salt can be coated. Suitable coatings include sodium sulphate, sodium carbonate, sodium silicate and mixtures thereof. Said coatings can be applied as a mixture applied to the surface or sequentially in layers.

Alkali metal percarbonates, particularly sodium percarbonate is the preferred bleach for use herein. The percarbonate is most preferably incorporated into the products in a coated form which provides in-product stability.

Potassium peroxymonopersulfate is another inorganic perhydrate salt of utility herein.

Typical organic bleaches are organic peroxyacids, especially dodecanediperoxoic acid, tetradecanediperoxoic acid, and hexadecanediperoxoic acid. Mono- and diperazelaic acid, mono- and diperbrassylic acid are also suitable herein. Diacyl and Tetraacylperoxides, for instance dibenzoyl peroxide and dilauroyl peroxide, are other organic peroxides that can be used in the context of this invention.

Further typical organic bleaches include the peroxyacids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid[phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi(6-aminopercaproic acid).

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 12 carbon atoms, in particular from 2 to 10 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), decanoyloxybenzoic acid (DOBA), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). If present the composition of the invention comprises from 0.01 to 5, preferably from 0.2 to 2% by weight of the composition of bleach activator, preferably TAED.

Bleach Catalyst

The composition herein preferably contains a bleach catalyst, preferably a metal containing bleach catalyst. More preferably the metal containing bleach catalyst is a transition metal containing bleach catalyst, especially a manganese or cobalt-containing bleach catalyst.

Bleach catalysts preferred for use herein include manganese triazacyclononane and related complexes; Co, Cu, Mn and Fe bispyridylamine and related complexes; and pentamine acetate cobalt(III) and related complexes.

Preferably the composition of the invention comprises from 0.001 to 0.5, more preferably from 0.002 to 0.05% of bleach catalyst by weight of the composition. Preferably the bleach catalyst is a manganese bleach catalyst.

Inorganic Builder

The composition of the invention preferably comprises an inorganic builder. Suitable inorganic builders are selected from the group consisting of carbonate, silicate and mixtures thereof. Especially preferred for use herein is sodium carbonate. Preferably the composition of the invention comprises from 5 to 50%, more preferably from 10 to 40% and especially from 15 to 30% of sodium carbonate by weight of the composition.

Surfactant

Surfactants suitable for use herein include non-ionic surfactants, preferably the compositions are free of any other surfactants. Traditionally, non-ionic surfactants have been used in automatic dishwashing for surface modification purposes in particular for sheeting to avoid filming and spotting and to improve shine. It has been found that non-ionic surfactants can also contribute to prevent redeposition of soils.

Preferably the composition of the invention comprises a non-ionic surfactant or a non-ionic surfactant system, more preferably the non-ionic surfactant or a non-ionic surfactant system has a phase inversion temperature, as measured at a concentration of 1% in distilled water, between 40 and 70° C., preferably between 45 and 65° C. By a "non-ionic surfactant system" is meant herein a mixture of two or more non-ionic surfactants. Preferred for use herein are non-ionic surfactant systems. They seem to have improved cleaning and finishing properties and better stability in product than single non-ionic surfactants.

Phase inversion temperature is the temperature below which a surfactant, or a mixture thereof, partitions preferentially into the water phase as oil-swollen micelles and above which it partitions preferentially into the oil phase as water swollen inverted micelles. Phase inversion temperature can be determined visually by identifying at which temperature cloudiness occurs.

The phase inversion temperature of a non-ionic surfactant or system can be determined as follows: a solution containing 1% of the corresponding surfactant or mixture by weight of the solution in distilled water is prepared. The solution is stirred gently before phase inversion temperature analysis to ensure that the process occurs in chemical equilibrium. The phase inversion temperature is taken in a thermostable bath by immersing the solutions in 75 mm sealed glass test tube. To ensure the absence of leakage, the test tube is weighed before and after phase inversion temperature measurement. The temperature is gradually increased at a rate of less than 1° C. per minute, until the temperature reaches a few degrees below the pre-estimated phase inversion temperature. Phase inversion temperature is determined visually at the first sign of turbidity.

Suitable nonionic surfactants include: i) ethoxylated non-ionic surfactants prepared by the reaction of a monohydroxy alkanol or alkyphenol with 6 to 20 carbon atoms with preferably at least 12 moles particularly preferred at least 16 moles, and still more preferred at least 20 moles of ethylene oxide per mole of alcohol or alkylphenol; ii) alcohol alkoxylated surfactants having a from 6 to 20 carbon atoms and at least one ethoxy and propoxy group. Preferred for use herein are mixtures of surfactants i) and ii).

Another suitable non-ionic surfactants are epoxy-capped poly(oxyalkylated) alcohols represented by the formula:

$$R1O[CH2CH(CH3)O]x[CH2CH2O]y[CH2CH(OH)R2] \quad (I)$$

wherein R1 is a linear or branched, aliphatic hydrocarbon radical having from 4 to 18 carbon atoms; R2 is a linear or branched aliphatic hydrocarbon radical having from 2 to 26 carbon atoms; x is an integer having an average value of from 0.5 to 1.5, more preferably about 1; and y is an integer having a value of at least 15, more preferably at least 20.

Preferably, the surfactant of formula I, at least about 10 carbon atoms in the terminal epoxide unit [CH2CH(OH) R2]. Suitable surfactants of formula I, according to the present invention, are Olin Corporation's POLY-TERGENT® SLF-18B nonionic surfactants, as described, for example, in WO 94/22800, published Oct. 13, 1994 by Olin Corporation.

Enzymes

In describing enzyme variants herein, the following nomenclature is used for ease of reference: Original amino acid(s):position(s):substituted amino acid(s). Standard enzyme IUPAC 1-letter codes for amino acids are used.

Proteases

Suitable proteases include metalloproteases and serine proteases, including neutral or alkaline microbial serine proteases, such as subtilisins (EC 3.4.21.62) as well as chemically or genetically modified mutants thereof. Suitable proteases include subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii.*

Especially preferred proteases for the detergent of the invention are polypeptides demonstrating at least 90%, preferably at least 95%, more preferably at least 98%, even more preferably at least 99% and especially 100% identity with the wild-type enzyme from *Bacillus lentus*, comprising mutations in one or more, preferably two or more and more preferably three or more of the following positions, using the BPN' numbering system and amino acid abbreviations as illustrated in WO00/37627, which is incorporated herein by reference: V68A, N87S, S99D, S99SD, S99A, S101G, S101M, S103A, V104N/I, G118V, G118R, S128L, P129Q, S130A, Y167A, R170S, A194P, V2051 and/or M222S.

Most preferably the protease is selected from the group comprising the below mutations (BPN' numbering system) versus either the PB92 wild-type (as disclosed in WO 08/010925) or the subtilisin 309 wild-type (sequence as per PB92 backbone, except comprising a natural variation of N87S).

(i) G118V+S128L+P129Q+S130A
(ii) S101M+G118V+S128L+P129Q+S130A
(iii) N76D+N87R+G118R+S128L+P129Q+S130A+S188D+N248R
(iv) N76D+N87R+G118R+S128L+P129Q+S130A+S188D+V244R
(v) N76D+N87R+G118R+S128L+P129Q+S130A
(vi) V68A+N87S+S101G+V104N Suitable commercially available protease enzymes include those sold under the trade names Savinase®, Polarzyme®, Kannase®, Ovozyme®, Everlase® and Esperase® by Novozymes A/S (Denmark), those sold under the tradename Properase®, Purafect®, Purafect Prime®, Purafect Ox®, FN3®, FN4®, Excellase®, Ultimase® and Purafect OXP® by Genencor International, those sold under the tradename Opticlean® and Optimase® by Solvay Enzymes, those available from Henkel/Kemira, namely BLAP.

Preferred levels of protease in the product of the invention include from about 0.1 to about 10, more preferably from about 0.5 to about 7 and especially from about 1 to about 6 mg of active protease.

Amylases

Preferred enzyme for use herein includes alpha-amylases, including those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334). Preferred amylases include:

(a) the variants described in U.S. Pat. No. 5,856,164 and WO99/23211, WO96/23873, WO00/60060 and WO06/002643, especially the variants with one or more substitutions in the following positions versus the AA560 enzyme listed as disclosed in WO06/002643:

9, 26, 30, 33, 82, 37, 106, 118, 128, 133, 149, 150, 160, 178, 182, 186, 193, 195, 202, 214, 231, 256, 257, 258, 269, 270, 272, 283, 295, 296, 298, 299, 303, 304, 305, 311, 314, 315, 318, 319, 320, 323, 339, 345, 361, 378, 383, 419, 421, 437, 441, 444, 445, 446, 447, 450, 458, 461, 471, 482, 484, preferably that also contain the deletions of D183* and G184*.

(b) variants exhibiting at least 95% identity with the wild-type enzyme from *Bacillus* sp.707 (as disclosed in U.S. Pat. No. 6,093, 562), especially those comprising one or more of the following mutations M202, M208S255, R172, and/or M261. Preferably said amylase comprises one of M202L or M202T mutations.

Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, POWERASE®, FUNGAMYL® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS® and PURASTAR OXAM® (Genencor International Inc., Palo Alto, Calif.) and KAM® (Kao, 14-10 Nihonbashi Kayabacho, 1-chome, Chuo-ku Tokyo 103-8210, Japan). Amylases especially preferred for use herein include NATALASE®, STAINZYME®, STAINZYME PLUS®, POWERASE® and mixtures thereof.

Preferably, the product of the invention comprises at least 0.01 mg, preferably from about 0.05 to about 10, more preferably from about 0.1 to about 6, especially from about 0.2 to about 5 mg of active amylase.

Preferably, the protease and/or amylase of the product of the invention are in the form of granulates, the granulates comprise less than 29% of sodium sulfate by weight of the granulate or the sodium sulfate and the active enzyme (protease and/or amylase) are in a weight ratio of less than 4:1.

Crystal Growth Inhibitor

Crystal growth inhibitors are materials that can bind to calcium carbonate crystals and prevent further growth of species such as aragonite and calcite.

Especially preferred crystal growth inhibitor for use herein is HEDP (1-hydroxyethylidene 1,1-diphosphonic acid). Preferably, the composition of the invention comprises from 0.01 to 5%, more preferably from 0.05 to 3% and especially from 0.5 to 2% of a crystal growth inhibitor by weight of the product, preferably HEDP.

Metal Care Agents

Metal care agents may prevent or reduce the tarnishing, corrosion or oxidation of metals, including aluminium, stainless steel and non-ferrous metals, such as silver and copper.

Preferably the composition of the invention comprises from 0.1 to 5%, more preferably from 0.2 to 4% and especially from 0.3 to 3% by weight of the product of a metal care agent, preferably the metal care agent is benzo triazole (BTA).

Glass Care Agents

Glass care agents protect the appearance of glass items during the dishwashing process. Preferably the composition of the invention comprises from 0.1 to 5%, more preferably from 0.2 to 4% and specially from 0.3 to 3% by weight of the composition of a metal care agent, preferably the glass care agent is a zinc containing material, specially hydrozincite.

The automatic dishwashing composition of the invention preferably has a pH as measured in 1% weight/volume aqueous solution in distilled water at 20° C. of from about 9 to about 12, more preferably from about 10 to less than about 11.5 and especially from about 10.5 to about 11.5.

The automatic dishwashing composition of the invention preferably has a reserve alkalinity of from about 10 to about 20, more preferably from about 12 to about 18 at a pH of 9.5 as measured in NaOH with 100 grams of product at 20° C.

Polymer synthesis

GPC(SEC) Method to determine the molecular weight of the polymer

The weight average molecular weight of the polymers (Mw) is determined using Size Exclusion Chromatography (SEC). SEC separation conditions were three hydrophilic Vinylpolymer network gel columns, in distilled water with the presence of 0,1% (w/w) trifluoroacetic acid/0,1M NaCl at 35° C. Calibration was done with narrowly distributed Poly(2-vinylpyridine)-standard of company PSS, Deutschland with molecular weights Mw=620 to Mw=2,070,000

Polymer 180% wt MPEG-MA (methyl polyethyleneglycol methacrylate) with 45 EO (ethylene oxide) and 20%wt QVI (3-methyl-l-vinylimidazolium)

In a 4 L stirred vessel, water (838,5 g) was charged and heated to 90° C. under a flow of nitrogen. A solution of Wako V50 (1,35 g, Wako Pure Chemical Industries, Ltd.) in water (12,15 g) was added over 4 h and a solution of methoxypolyethylenglycol methacrylate with molecular weight ~2000 g/mol (50%, 1080 g, Visiomer MPEG 2005 MA W, Evonik Industries) and 3-Methyl-1-vinyl -1H-imidazolium-methyl-sulfate (45%, 300 g, BASF SE) over 3 hours. The polymerization mixture was kept at this temperature for an additional 30 min after both streams finished. Subsequently a solution of Wako V50 (3,38 g) in water (30,38 g) was added over 15 min, stirred for 1 h, then left to cool down to room temperature. The GPC gave values of weight average molecular weight is 143,000 g/mol.

Example Formulations

| | Compositions (g/active per wash) | | | | |
|---|---|---|---|---|---|
| | 1 | 2 | 3 | 4 | 5 |
| Powder section | | | | | |
| Sodium Carbonate | 7.0 g | 7.0 g | 6.4 g | 6.4 g | 6.4 g |
| MGDA | 2.2 g | 2.2 g | 2.8 g | 2.8 g | 2.8 g |
| Percarbonate | 1.4 g | 1.4 g | 0.9 g | 0.9 g | 0.9 g |
| Bleach activator | 0.3 g | 0.3 g | — | — | — |
| Bleach catalyst | 1 mg | 1 mg | 1 mg | 1 mg | 1 mg |
| Nonionic surfactant 1 | 0.1 g | 0.1 g | 0.1 g | 0.1 | 0.1 |
| Stainzyme Plus | 3 mg | 3 mg | 9 mg | 9 mg | 9 mg |
| Ultimase | 10 mg | 10 mg | 34 mg | 34 mg | 34 mg |
| HEDP | 0.1 g | 0.1 g | — | — | — |
| SMSS Polymer 1 | 0.6 g | — | 0.6 g | 0.3 g | — |
| SMSS Polymer 2 | — | 0.3 g | — | — | 0.6 g |
| Dispersant polymer 1 | 0.6 g | 0.6 g | — | 0.6 g | |
| Dispersant polymer 2 | — | | 1.2 g | | 0.6 g |
| Liquid section | | | | | |
| Nonionic surfactant 1 | 0.7 g | 0.7 g | 0.7 g | 0.7 g | 0.7 g |
| Nonionic surfactant 2 | 0.9 g | 0.9 g | 0.9 g | 0.9 g | 0.9 g |
| DPG | 0.4 g | 0.4 g | 0.4 g | 0.4 g | 0.4 g |
| Water soluble film | | | | | |
| PVA | 0.6 g | 0.6 g | 0.6 g | 0.6 g | 0.6 g |

MGDA Trisodium salt of methylglycinediacetic acid, supplied by BASF
Bleach activator Tetraacetylethylenediamine
Bleach catalyst Pentaamino cobalt acetate nitrate
Nonionic surfactant 1 Plurafac SLF 180, supplied by BASF.
Nonionic surfactant 2 Lutensol TO7, supplied by BASF.

-continued

| | Compositions (g/active per wash) | | | | |
|---|---|---|---|---|---|
| | 1 | 2 | 3 | 4 | 5 |
| HEDP | 1-hydroxyethane 1,1-diphosphonic acid | | | | |
| SMSS polymer 1 | 80% wt MPEG with 45 EO and 20% wt QVI, Mw 143,000 | | | | |
| SMSS polymer 2 | 80% wt MPEG with 45 EO and 20% wt QVI, Mw 179,000 | | | | |
| Dispersant polymer 1 | Carboxylated/sulphonated polymer supplied as Acusol 588 supplied by Dow. | | | | |
| Dispersant polymer 2 | polymer of acrylic acid supplied as Sokalan PA 25, 4,000 g/mol supplied by BASF. | | | | |

The compositions were made into superposed dual-compartment water-soluble pouches. One compartment contained the solid composition and the other compartment the liquid composition.

EXAMPLES

Example 1

Contact Angle of the Compositions

The contact angle of deionised water on glasses after being washed with a cleaning composition outside the scope of the invention (Composition A) and the composition of the invention (Composition B) were measured. The compositions were made into superposed dual-compartment water-soluble pouches. One compartment contained the solid composition and the other compartment the liquid composition.

| Active material | Composition A Comparative | Composition B Invention |
|---|---|---|
| Solid compartment | | |
| Sodium Carbonate | 3.0 g | 3.0 g |
| MGDA | 5.7 g | 5.7 g |
| Percarbonate | 2.8 g | 2.8 g |
| Stainzyme Pluse | 4 mg | 4 mg |
| Ultimase | 34 mg | 34 mg |
| HEDP | 0.1 g | 0.1 g |
| MnTACN | 4 mg | 4 mg |
| Dispersant polymer | 0.5 g | 0.25 g |
| SMSS polymer | — | 0.25 g |
| Liquid compartment | | |
| Nonionic surfactant 2 | 0.9 g | 0.9 g |
| Nonionic surfactant 1 | 0.7 g | 0.7 g |
| Dipropylene glycol | 0.4 g | 0.4 g |
| Film | | |
| Poly vinyl alcohol | 0.6 g | 0.6 g |

| | |
|---|---|
| MGDA | Trisodium salt of methylglycinediacetic acid, supplied by BASF |
| HEDP | 1-hydroxyethane 1,1-diphosphonic acid |
| Nonionic surfactant 1 | Plurafac SLF 180, supplied by BASF. |
| Nonionic surfactant 2 | Lutensol TO7, supplied by BASF. |
| SMSS polymer 1 | 80% wt MPEG with 45 EO and 20% wt QVI, Mw 143,000 |
| Dispersant polymer 1 | Carboxylated/sulfonated polymer supplied as Acusol 588 supplied by Dow. |

Four new Libbey glasses per test leg were conditioned, the glasses were washed with a standard dishwashing detergent followed by an acidic wash with 20 g of citric acid; both washes were carried out using soft water (3 US gpg), in a normal 50° C. cycle.

The wash was carried out using a Miele GSL dishwashing machine, in a normal wash 50° C. setting. On each cycle two pots containing 50 g of frozen soil (as detailed herein before) were added into the washing machine at the start of the wash, at the same time as the cleaning composition. The inlet water was from a borehole with 20 US gpg of hardness.

The contact angle measurements were taken using the Kruss mobile drop equipment and Drop Shape Analysis 2 software. Six measurements were made around the side of the individual glasses (each side of the drop) and the average value is reported.

| | Composition A Comparative | Composition B Invention |
|---|---|---|
| Contact angle | 62.89 | 43.49 |

Example 2

Multi-Cycle Spotting Test

Three compositions were prepared to illustrate the synergistic effect of combining a dispersing polymer with a surface-modification surface-substantive polymer according to the invention. The compositions were made into superposed dual-compartment water-soluble pouches. One compartment contained the solid composition and the other compartment the liquid composition.

| Active material | Composition C Comparative | Composition D Comparative | Composition E Invention |
|---|---|---|---|
| Solid compartment | | | |
| Sodium Carbonate | 1.0 g | 1.0 g | 1.0 g |
| MGDA | 4.2 g | 4.2 g | 4.2 g |
| Percarbonate | 1.8 g | 1.8 g | 1.8 g |
| Stainzyme Plus | 4 mg | 4 mg | 4 mg |
| Ultimase | 34 mg | 34 mg | 34 mg |
| HEDP | 0.1 g | 0.1 g | 0.1 g |
| Dispersant polymer | 1.2 g | — | 0.6 g |
| SMSSpolymer | — | 0.6 g | 0.3 g |
| Liquid compartment | | | |
| Nonionic surfactant 2 | 0.9 g | 0.9 g | 0.9 g |
| Nonionic surfactant 1 | 0.7 g | 0.7 g | 0.7 g |
| Dipropylene glycol | 0.4 g | 0.4 g | 0.4 g |
| Film | | | |
| Poly vinyl alcohol | 0.6 g | 0.6 g | 0.6 g |

| | |
|---|---|
| MGDA | Trisodium salt of methylglycinediacetic acid, supplied by BASF |
| HEDP | 1-hydroxyethane 1,1-diphosphonic acid |
| Nonionic surfactant 1 | Plurafac SLF 180, supplied by BASF. |
| Nonionic surfactant 2 | Lutensol TO7, supplied by BASF. |
| SMSSpolymer | 80% wt MPEG with 45 E0 and 20% wt QVI, Mw 143,000 |
| Dispersant polymer | Carboxylated/sulphonated copolymer supplied as Acusol 588 supplied by Dow. |

Six new Libbey glasses per test leg were conditioned before the multi-cycle test, the glasses were washed with a standard dishwashing detergent followed by an acidic wash with 20 g of citric acid; both washes were carried out using soft water (3 US gpg), in a normal 50° C. cycle.

The multi-cycle filming test was carried out using a Miele GSL dishwashing machine, in a normal wash 50° C. setting. On each cycle two pots containing 50 g of frozen soil (as detailed herein before) were added into the washing machine at the start of the wash, additionally 10 g of margarine are spread on the internal bottom of a stainless steel pan, which then is added on the bottom basket as ballast. The inlet water was from a borehole with 20 US gpg of hardness.

Spot count and stainless steel grading.

After running 2 and 4 consecutives cycles at the specified conditions, the glasses were then photographed in a photographic booth with controlled light and constant settings against a black background. The resulting images were analysed using computer aided software to count spots on the glasses.

The photographs were taken in black and white and the gray scale of each pixel is calculated from 0 to 255, where 0 is completely black and 255 is completely white.

The photograph size is measured in pixels; a typical photograph contains 1944x 2592 pixels, equivalent to about 5 million pixels. An area is selected on the glass surface, eliminating the edges and bottom of the glass, where the light intensity is increased, this area is the analyzable area. Spots appear whiter versus the rest of the background and for them to be counted they need to be 4 gray scales higher versus the background. A spot is defined as a circular cluster larger than 4 pixels with higher gray scale (4 units) versus the background.

The stainless steel pans were also visually evaluated after the four cycles.

Results

Figure 2:
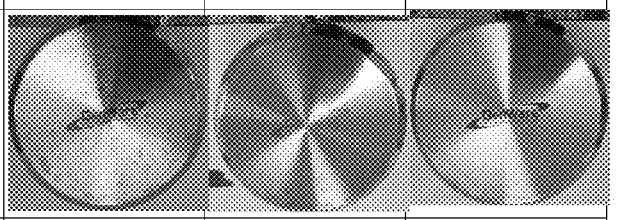
FIG. 2 shows the bottom of stainless steel pans washed with comparative compositions (Compositions C and D) and with the composition of the invention (Composition E).

For the previous results (FIG. 2) it is possible to see that the amount of spots is reduced when compositions according to the invention are used, showing less spots and better stainless steel care after 4 wash cycles.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A phosphate free automatic dishwashing cleaning composition comprising a dispersant polymer and a surface-modification surface-substantive polymer wherein the surface-modification surface-substantive polymer is a cationic polymer comprising in copolymerized form from:

i. about 60% to about 99% by weight of the cationic polymer of at least one monoethylenically unsaturated polyalkylene oxide monomer of the formula I (monomer (A))

I

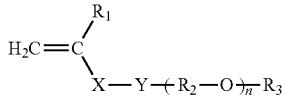

in which the variables have the following meanings:

X is —CH2- or —CO—, if Y is —O—;

X is —CO—, if Y is —NH—

Y is —O—or —NH—;

R1 is hydrogen or methyl;

R2 are identical or different C2-C6-alkylene radicals;

R3 is H or C1-C4 alkyl;

n is an integer from 3 to 100, ii. from about 1 to about 40% by weight of the cationic polymer of at least one quaternized nitrogen-containing monomer, selected from the group consisting of at least one of the monomers of the formula IIa to IId (monomer (B))

IIa

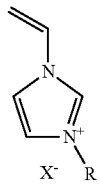

IIb

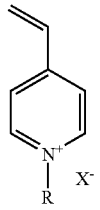

IIc

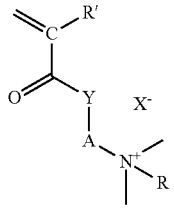

IId

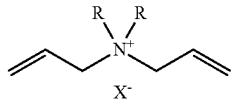

in which the variables have the following meanings:

R is C1-C4 alkyl or benzyl;

R' is hydrogen or methyl;

Y is —O —or —NH—;

A is C1-C6 alkylene;

X—is halide, C1-C4-alkyl sulfate, C1-C4-alkylsulfonate and C1-C4-alkyl carbonate;

iii. from about 0 to 15% by weight of the cationic polymer of at least one anionic monoethylenically unsaturated monomer (monomer (C), and iv. from about 0 to 30% by weight of the cationic polymer of at least one other nonionic monoethylenically unsaturated monomer (monomer (D), and the cationic polymer has a weight average molecular weight (Mw) from 2,000 to 500,000 g/mol; and wherein the dispersant polymer is a carboxylated/sulfonated polymer.

2. A composition according to claim 1 wherein the surface-modification surface-substantive polymer is a cationic polymer comprising in copolymerized form from:

i. about 60% to about 99% by weight of the cationic polymer of at least one monoethylenically unsaturated polyalkylene oxide monomer of the formula I (monomer (A))

I

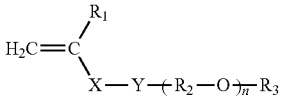

in which the variables have the following meanings:

X —CO—

Y —O—;

$R_1$is hydrogen or methyl;

$R_2$ is ethylene, linear or branched propylene or mixtures thereof;

$R_3$ is methyl;

n is an integer from 15 to 60, ii. from about 1 to about 40% by weight of the cationic polymer of at least one quaternized nitrogen-containing monomer, selected from the group consisting of at least one of the monomers of the formula IIa to IId (monomer (B))

1.

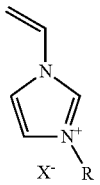

2. IIa

3.

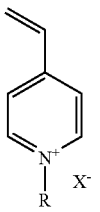

4. IIb

5.

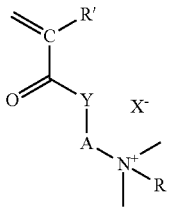

6. IIc

-continued

7.

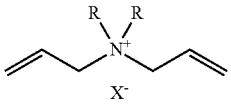

8. IId in which the variables have the following meanings:

R is C1-C4 alkyl or benzyl;

R' is hydrogen or methyl;

Y is —O— or —NH—;

A is C1-C6 alkylene;

X—is halide, C1-C4-alkyl sulfate, C1-C4-alkylsulfonate and C1-C4-alkyl carbonate;

iii. from about 0 to about 15% by weight of the cationic polymer of at least one anionic monoethylenically unsaturated monomer (monomer (C), and iv. from about 0 to about 30% by weight of the cationic polymer of at least one other nonionic monoethylenically unsaturated monomer (monomer (D), and the cationic polymer has a weight average molecular weight (Mw) from about 25,000 g/mol to about 200,000 g/mol.

3. A composition according to claim 1 wherein the surface-modification surface-substantive polymer is a cationic polymer comprising in copolymerized form from:

i. about 60% to about 99% by weight of the cationic polymer of at least one monoethylenically unsaturated polyalkylene oxide monomer of the formula I (monomer (A)

I

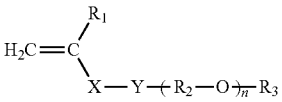

in which the variables have the following meanings:

X is —CH2-or —CO—, if Y is —O—;

X is —CO—, if Y is —NH—;

Y is —O—or —NH—;

R1 is hydrogen or methyl;

R2 are identical or different C2-C6-alkylene radicals;

R3 is H or C1-C4 alkyl;

n is an integer from about 15 to about 60, ii. from about 1 to 40% by weight of the cationic polymer of at least one quaternized nitrogen-containing monomer, selected from the group consisting of at least one of the monomers of the formula IIa to IId (monomer (B))

9.

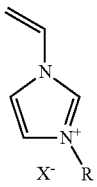

10. IIa

-continued

11.

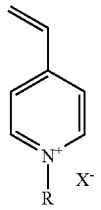

12. IIb

13.

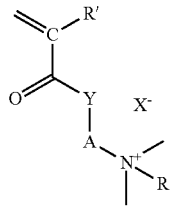

14. IIc

15.

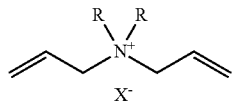

16. IId in which the variables have the following meanings:

R is C1-C4 alkyl or benzyl;

R' is hydrogen or methyl;

Y is —O—or —NH—;

A is C1-C6 alkylene;

X—is halide, C1-C4-alkyl sulfate, C1-C4-alkylsulfonate and C1-C4-alkyl carbonate;

iii. from 0 to 15% by weight of the cationic polymer of at least one anionic monoethylenically unsaturated monomer (monomer (C)), and iv. from 0 to 30% by weight of the cationic polymer of at least one other nonionic monoethylenically unsaturated monomer (monomer (D)), and the cationic polymer has a weight average molecular weight (Mw) from about 25,000 g/mol to about 200,000 g/mol;

wherein the cationic polymer comprises from about 69 to about 89% by weight of monomer (A) and from about 9 to about 29% by weight of monomer (B) and wherein monomer (A) is methylpolyethylene glycol (meth) acrylate and wherein monomer (B) is a salt of 3-methyl- 1-vinylimidazolium.

4. A composition according to claim 1 wherein the surface-modification surface-substantive polymer is a cationic polymer comprising in copolymerized form from:

i. about 60% to about 99% by weight of the cationic polymer of at least one monoethylenically unsaturated polyalkylene oxide monomer of the formula I (monomer (A))

I

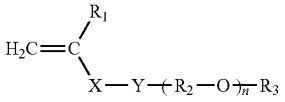

in which the variables have the following meanings:

X is —CH2-or —CO—, if Y is —O—;

X is —CO—, if Y is —NH—;

Y is —O—or —NH—;

R1 is hydrogen or methyl;

R2 are identical or different C2-C6-alkylene radicals;

R3 is H or C1-C4 alkyl;

n is an integer from about 15 to about 60, ii. from about 1 to about 40% by weight of the cationic polymer of at least one quaternized nitrogen-containing monomer, selected from the group consisting of at least one of the monomers of the formula IIa to IId (monomer (B))

17.

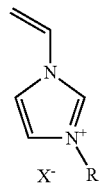

18. IIa

19.

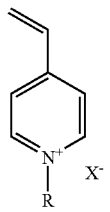

20. IIb

21.

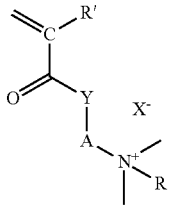

22. IIc

23.

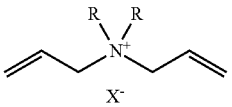

24. IId in which the variables have the following meanings:

R is C1-C4 alkyl or benzyl;

R' is hydrogen or methyl;

Y is —O—or —NH—;

A is C1-C6 alkylene;

X—is halide, C1-C4-alkyl sulfate, C1-C4-alkylsulfonate and C1-C4-alkyl carbonate;

iii. from about 0 to about 15% by weight of the cationic polymer of at least one anionic monoethylenically unsaturated monomer (monomer (C)), and iv. from about 0 to about 30% by weight of the cationic polymer of at least one other nonionic monoethylenically unsaturated monomer (monomer (D)), and the cationic polymer has a weight average molecular weight (Mw) from about 25,000 g/mol to about 200,000 g/mol, wherein the weight ratio of monomer (A) to monomer (B) is ≥2:1 and for the case where the copolymer comprises a monomer (C), the weight ratio of monomer (B) to monomer (C) is also ≥2:1, and wherein monomer (A) comprises methylpolyethylene glycol (meth)acrylate and monomer (B) comprises a salt of 3-methyl-1-vinylimidazolium.

5. A composition according to claim 1 comprising a complexing agent selected from the group consisting of methyl glycine diacetic acid, its salts and derivatives thereof, glutamic-N,N-diacetic acid, its salts and derivatives thereof, iminodisuccinic acid, its salts and derivatives thereof, carboxy methyl inulin, its salts and derivatives thereof, and mixtures thereof.

6. A composition according to claim 1 wherein the composition comprises bleach and a manganese bleach catalyst.

7. A composition according to claim 1 wherein the composition comprises a crystal growth inhibitor.

8. A method of reducing spotting on dishware during automatic dishwashing, the method comprising the following steps:

a) placing soiled dishware into an automatic dishwasher;

b) providing an automatic dishwashing cleaning composition according to claim 1; and running the automatic dishwasher, wherein the dispersant polymer and the surface-modification surface-substantive polymer in the automatic dishwashing cleaning composition contribute to the reduction of spotting on dishware.

* * * * *